United States Patent [19]

Mainardi

[11] Patent Number: 4,910,793

[45] Date of Patent: Mar. 20, 1990

[54] TWO-WAY TRANSMISSION SYSTEM FOR GROUND/MOBILE STATION COMMUNICATIONS

[75] Inventor: Jacques Mainardi, Lievin, France

[73] Assignee: Alsthom, Paris, France

[21] Appl. No.: 130,122

[22] Filed: Dec. 8, 1987

[30] Foreign Application Priority Data

Dec. 8, 1986 [FR] France ..... 86 17137

[51] Int. Cl.[4] ..... H04B 1/50

[52] U.S. Cl. ..... 455/55; 455/45; 370/74; 370/69.1; 246/7

[58] Field of Search ..... 455/55, 41, 45, 54; 246/8, 29 R, 30, 7, 167 R; 340/47, 48; 370/74, 69.1

[56] References Cited

U.S. PATENT DOCUMENTS

| | | | |
|---|---|---|---|
| Re. 28,867 | 6/1976 | Baba et al. | 455/55 |
| 2,635,233 | 4/1953 | Homrighous | 455/55 |
| 3,629,707 | 12/1971 | Baba | 325/53 |
| 3,743,935 | 7/1973 | Alt | 455/55 |
| 3,750,020 | 7/1973 | Baba et al. | 455/55 |
| 4,078,245 | 3/1978 | Johnson et al. | 455/45 |
| 4,517,562 | 5/1985 | Martinez | 455/45 |
| 4,584,708 | 4/1986 | Eilers et al. | 455/45 |
| 4,618,996 | 10/1986 | Rafal et al. | 370/74 |

FOREIGN PATENT DOCUMENTS

| | | | |
|---|---|---|---|
| 55-141839 | 11/1980 | Japan | 455/55 |
| 2106357 | 4/1983 | United Kingdom . | |

OTHER PUBLICATIONS

IEEE Transactions on Vehicular Communications, vol. VC-13, No. 1, 9/1964, pp. 1-18, New York, U.S.A.; T. Kawakami et al: "Waveguide Communication System for Centralized Railway Traffic Control".

Telcom Report, vol. 8, No. 3, 1985, pp. 149-151, Berlin, Germany; F. Sonntag: "Carrier Frequency Generation and Derivation for TV Transmission on 18/60 MHz Systems".

*Primary Examiner*—Robert L. Griffin
*Assistant Examiner*—Ralph Smith
*Attorney, Agent, or Firm*—Sughrue, Mion, Zinn, Macpeak & Seas

[57] ABSTRACT

Information is transmitted at microwave frequencies, the ground station being connected to a waveguide (25) and the station aboard a railway vehicle being connected to an antenna (26). Each station comprises a microwave generator (19) supplying a carrier, transmitters (3 through 7) supplying subcarriers, receivers (28 through 32) and a pilot generator (1). The carrier and subcarrier frequencies are multiples of the pilot frequency and the frequency difference between adjacent subcarriers equals the pilot frequency. A transmitter mixer (MTX) receives the carrier and the subcarriers and is connected to a circulator (24), itself linked to the waveguide (25) in the ground station and to the vehicle station antenna. A receiver mixer (MRX) is connected via a filter (23) to the circulator (24) and receives the carrier from the microwave generator; the latter mixer is connected to the receivers (28 through 32) to which it sends the subcarriers transmitted by the other station.

9 Claims, 2 Drawing Sheets

TWO-WAY TRANSMISSION SYSTEM FOR GROUND/MOBILE STATION COMMUNICATIONS

BACKGROUND OF THE INVENTION

This invention concerns a two-way information transmission system between a mobile station and a ground control station; the term information being understood to means analog and/or digital signals corresponding in a general way to sounds, pictures, instructions, measurements, etc.

The mobile station, which moves along a known path, may be for example a train, a funicular, an elevator, an automobile, a containment shell inspection truck, etc. The control station is on the ground and stationary.

Transmissions are effected for example through a waveguide disposed along the path followed by the mobile station, equipped with a transmitting and receiving antenna, moving alongside the waveguide. A waveguide transmission system is described in the article "Waveguide Communication System for Centralized Railway Traffic Control" by T. Kawakami et al, IEEE Trans. on Vehicular Communications, Sept. 1964, pp. 1–18. The article entitled "High Frequency Guided Electromagnetic Waves in Application to Railway Signalling and Control", by H. M. Barlow, in The Radio and Electronic Engineer, May 1967, pp. 275–281, also discusses the use of microwaves for locating trains and for telephone communications. These articles essentially concern the problem of transmission of a microwave by a waveguide alongside a railroad and an antenna on the railway vehicle and do not discuss the transmission system, in order words the transmitter-receiver equipment on the ground and aboard the moving vehicle. They merely indicate that the frequencies allocated for the vehicle-to-ground transmission direction are lower than those allocated for the ground-to-vehicle transmission direction, and that a separate channel is assigned to television transmission in the ground-to-vehicle direction.

The presence of several frequencies corresponding to the transmission channels allocated to the different transmissions causes interferences which disturb the transmissions, such that the latter can become unusable.

SUMMARY OF THE INVENTION

The invention is directed to preventing such interference.

Another object of the invention is to transmit, in each direction of ground/vehicle transmission, a signal enabling the transmissions in each direction to be checked.

The invention provides a two-way information transmission system between a ground control station connected to a waveguide and a vehicular mobile station connected to an antenna moving alongside the waveguide, each station comprising a transmitter-receiver unit, the stations transmitting in different frequency bands and the ground station transmitting in the band with the higher frequencies, wherein each transmitter-receiver unit comprises a pilot signal generator supplying a pilot frequency, a microwave generator supplying a carrier at a frequency which is a multiple of the pilot frequency, a coupler with input connected to the microwave generator, one output connected to a transmitter mixer and another output connected to a receiver mixer, transmitter circuits each connected to the pilot generator and each supplying a subcarrier at a frequency which is a multiple of the pilot frequency, the subcarriers having different, evenly spaced frequencies, the difference between successive subcarrier frequencies being equal to the pilot frequency and the frequencies of the subcarriers being less than the frequency of the carrier a transmission coupler input-connected to the transmitter circuits and output-connected to the transmitter mixer, a circulator connected to the waveguide, to the transmitter mixer and, via a filter, to the receiver mixer, and a receiver coupler with an input connected to the receiver mixer and output connected to receivers to which it routes subcarriers that it receives from the receiver mixer.

The bidirectional exchange of information between two stations, which in the present case are a ground control station and a mobile station aboard a vehicle, takes place in both directions, in other words from the ground station to the mobile station and vice versa, which requires each station to be able to transmit and receive, the ground station transmitting in a higher frequency channel than the mobile station,.

The various signals to be transmitted include difficult-to-mainpulate, easily disturbed video signals. Disturbances thereto appear on-screen as a shot-silk effect, even in the case of small-amplitude signals.

To eliminate these disturbances and in accordance with the invention, the various signals to be transmitted are synchronized together and frequency-controlled. This is done using a pilot frequency fp equal to the difference in frequency between the television picture carrier and accompanying sound carrier.

In France this difference in 6.5 MHz; the transmission system is therefore controlled to this frequency or multiples thereof.

The invention also provides for transmission in each direction of a check signal used to check the transmissions, said transmission check signal being an unmodulated carrier, at a specific frequency.

The various transmissions so far defined concern pictures (television), the sound accompanying the pictures (television sound), sounds in general and in particular telephone conversations, data in digital form, especially for exchange of instructions, data or commands between the ground station and the vehicles, and the check signal.

It is therefore necessary to have, in each direction, the following:

a video channel (pictures alone),
an accompanying sound channel (television sound),
a multiplex sound channel,
a digital channel,
a check signal channel.

The multiplex sound channel serves to transmit the different sounds, in particular telephone conversations, using a multiplexing technique, f for example the well known pulse code modulation (PCM) technique.

This gives a base band in which the video channel occupies the low frequencies, its bandwidth being $2\times6$ MHz, the accompanying sound being transmitted by a carrier at a frequency fp higher, ie. 6.5 MHz, than that of the video carrier. The width of the base band of a transmission channel is 5 fp, ie. 32.5 MHz, within which the distribution of the carriers of the channels is as follows, beginning with the lowest frequency of the transmission channel, whether this be the ground-to-vehicle direction transmission channel or the vehicle-to-ground direction transmission channel:

video carrier at fp =6.5 MHz,
accompanying sound carrier at 2 fp=13 MHz,
multiplex sound carrier at 3 fp=19.5 MHz,
digital carrier at 4 fp=26 MHz,
check signal carrier at 5 fp=32.5 MHz.

The different carriers are separated by a constant interval equal to fp (the pilot frequency), the check signal carrier having the highest frequency.

As transmissions are effected in microwave frequencies, the center frequency Fo for the transmissions as a whole, in other words for both directions of transmission, is selected as a multiple of the pilot frequency fp=6.5 MHz, and can be for example Fo=2450.5 MHz.

Leaving a safety margin of fp between the center frequency and the two channels to either side thereof, the channel assigned to vehicle-to-ground transmissions lies between 2411.5 MHz and 2444 MHz, the video channel being at 2418 MHz, and the channel assigned to ground-to-vehicle transmissions lies between 2457 MHz and 2489.5 MHz, the video channel being at 2463.5 MHz.

Each of the different transmission frequency bands of each channel is obtained by addition of an intermediate frequency, termed a subcarrier, with a frequency F of a carrier supplied by a microwave generator, the frequencies of the subcarriers and frequency F being multiples of the pilot frequency fp.

According to need, these intermediate frequencies can be located in VHF band III and the CATV superband, or in UHF bands IV and V. To allow use of standard television sets, UHF bands IV and V are used, such that the intermediate frequencies are of the order of 600 MHz.

The intermediate frequencies for the vehicle-to-ground direction are 572 MHz, 578.5 MHz, 585 MHz, 591.5 MHz and 598 MHz, the 572 MHz intermediate frequency being that of the video channel.

The intermediate frequencies for the ground-to-vehicle direction are 617.5 MHz, 624 MHz, 630.5 MHz, 637 MHz and 643.5 MHz, the 617.5 MHz intermediate frequency being that of the video channel. The microwave carrier frequency F is than 1846 MHz for each direction of transmission, which indeed yields a center frequency Fo of 2450.5 MHz.

The signals in each direction of transmission are subject to large level fluctuations as they are transmitted by the waveguide and the antenna. It is therefore advantageous, at reception, to be able to control the gain of the receivers according to the levels received and such gain control will be all the better for being operated on an unmodulated signal. To this end, the check signal subcarrier is used in both transmission direction so that an automatic gain control circuit delivers a voltage proportion to the level of the said subcarrier, the latter's level having experienced the same fluctuations as the levels of the other subcarriers transmitted in the same channel.

BRIEF DESCRIPTION OF THE DRAWINGS

The invention will be readily understood in reading the following description of one embodiment thereof, illustrated by the appended figures in which.

DETAILED DESCRIPTION OF THE INVENTION

Figure 1:
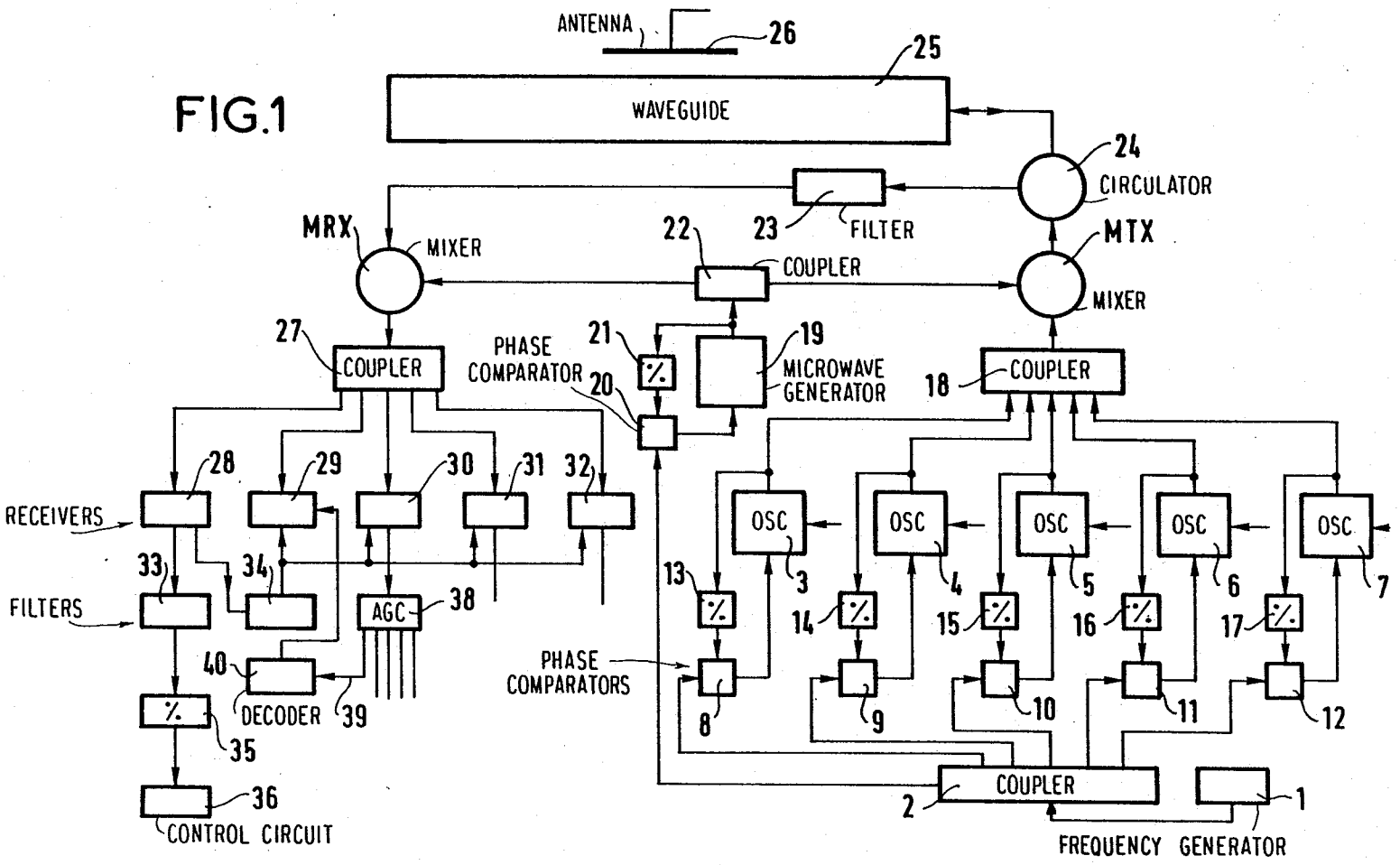
FIG. 1 is an overall block diagram of a transmitter-receiver unit according to the invention, for the ground station.

FIG. 1 diagrams a transmitter-receiver unit for a ground station, connected to a waveguide 25 arranged alongside a railroad, the numeral 26 representing an antenna on a railway vehicle, which antenna moves alongside the waveguide.

A microwave circulator 24 is connected to the waveguide 25; it is connected directly to a transmitter mixer MTX, and via a filter 23 to a receiver mixer MRX; the two mixers are connected to a coupler 22, which is itself connected to a microwave generator 19 supplying a signal at a frequency F=1846 MHz. The transmitter mixer MTX is connected to a transmitter coupler 18 from which it receives the signals each carried by a subcarrier; the receiver mixer MRX is connected to a receiver coupler 27 to which it supplies signals carried by vehicles's subcarriers.

The transmitter mixer MTX receives the F frequency signal from coupler 22 and signals from the transmitter coupler 18, the frequencies of the subcarriers of these signals being lower than the frequency F of the microwave signal; said frequencies are for example in UHF band V. In the transmitter mixer the frequency of each signal delivered by the transmitter coupler is added to the frequency F, and the resulting signals are fed to the circulator 24 which routes them to the waveguide 25.

Figure 2:
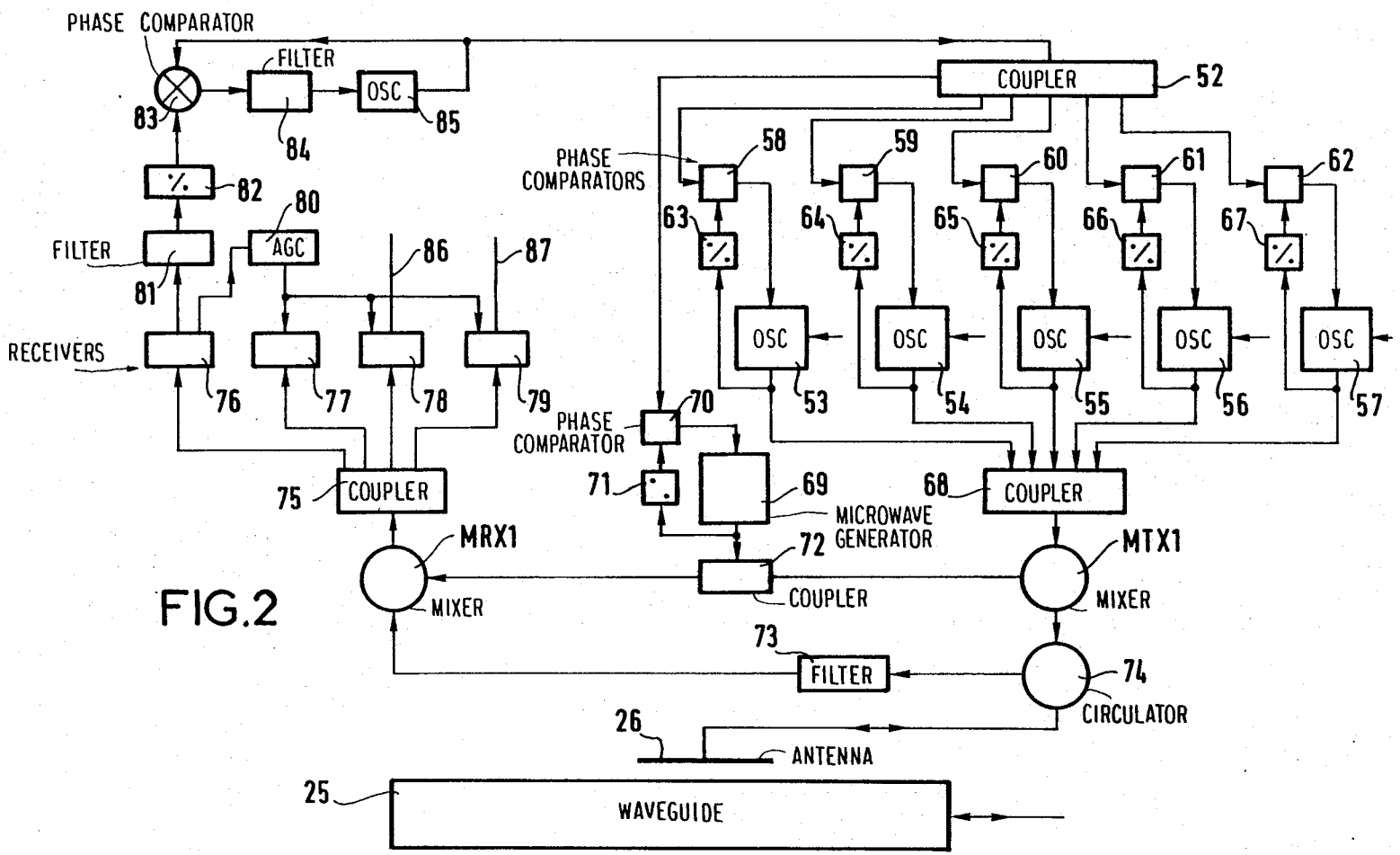
FIG. 2 is an overall block diagram of a transmitter-receiver unit according to the invention, for a vehicle.

In the vehicle there is likewise, as will be detailed in the description of FIG. 2, a microwave generator which supplies a signal at the same frequency F=1846 MHz as that of the ground station, and the frequencies of the subcarriers of the signals to be transmitted are lower than those of the ground station. The frequency of each signal is likewise added to the frequency F and the resulting signals are emitted by the antenna 26 and transmitted by the waveguide 25 to the circulator 24 of the ground station, which routes them to the receiver mixer MRX. The receiver mixer, receiving the F=1846 MHz signal from coupler 22, supplies to receiver coupler 27, and by subtraction of frequency F from the frequencies of the received signals, signals whose frequencies are those of the subcarriers used in the vehicle.

In FIG. 1, a frequency generator 1, consisting of a highly stable oscillator, delivers a signal at frequency fp=6.5 MHz, termed the pilot frequency.

The pilot frequency is distributed by a coupler 2 among phase comparators 8, 9, 10, 11, 12 and 20 of any known type, namely for example type MC 14152 made by Motorola. Phase comparators 8 through 12 have their outputs connected to oscillator circuits, 3 through 7 respectively, said oscillator circuits each having a modulation input and being of the Siemens TDA 5660 type. The frequencies of these oscillator circuits may for example be 617.5 MHz, 624 MHz, 630.5 MHz, 637 MHz and 643.5 MHz --actually the subcarrier frequencies. Attention is drawn to the fact that the 643.5 MHz frequency subcarrier, which corresponds to the check signal, is not modulated.

Oscillator circuits 3 and 4, corresponding to the video and television sound channels, receive modulation signals corresponding to the television signal picture and sound portions respectively; oscillator circuit 5, which is reserved for the multiplexed sound, is modulated by a signal which is a multiplex of the sound channels wherein each frame is assigned to a distinct sound channel, carrying a telephone conversation for example, or an audio program. The oscillator circuit designated by the numeral 6, assigned to digital transmissions, is modulated by a multiplex of binary coded decimal data.

The output of each oscillator circuit 3 through 7 is connected to the transmitter coupler 18 on the one hand, and to the phase comparator associated therewith via a frequency divider 13 through 17 on the other hand.

The frequency dividers 13 through 17 are respectively dividers by 95, 96, 97, 98 and 99, such that a 6.5 MHz signal appears at the output of each divider.

The phase comparator 20 is output-connected to the microwave generator 19, which is itself output-connected on one hand to the coupler 22 and on another hand to same comparator 20 via a divide-by-284 frequency divider 21; division of frequency F=1846 MHz yields a 6.5 MHz signal.

The receiver coupler 27 outputs the various modulated subcarriers of the signals sent by the vehicle to receivers 28, 29, 30, 31, 32. The frequencies of these subcarriers may for example be 572 MHz for the video channel 578.5 MHz for a reserve channel, 585 MHz for the multiplex sound channel, 591.5 MHz for the digital channel and 598 MHz for the check signal channel.

The check signal receiver 28 receives the 598 MHz check signal subcarrier and the receiver output is connected to, on one hand, a filter 33 and on the other hand, an automatic again control circuit 34. The filter 33 is connected to a divide-by-92 frequency divider 35 which supplies a check signal at 6.5 MHz to a control circuit 36. The output of automatic gain control circuit 34 drives receivers 29, 30, 31 and 32.

Receiver 29 is a conventional television receiver which receives a video signal from the receiver coupler 27 at the 572 MHz frequency.

It was assumed in FIG. 1 that the television sound was transmitted by the vehicle over the multiplex sound channel at 585 MHz, instead of being transmitted by a separate television sound channel. The multiplex sound receiver 30 delivers a digital multiplex to a demultiplexer 38, which supplies to different links the different sound channels, in binary form. Link 39 corresponds to the (television) sound channel accompanying the video channel and is connected to a decoder 40 whose output delivers the accompanying sound, in analog form, to the television receiver 29.

Digital receiver 31 supplies information in binary form; receiver 32 is a spare, operating at 578.5 MHz, since this frequency is not used by the vehicle for the accompanying sound of the 572 MHz video channel.

FIG. 2 diagrams a transmitter-receiver unit for a vehicle, said until being connected to the antenna 26 moving past the waveguide 25. As in the ground station transceiver, the unit diagramed in FIG. 2 contains a circuit consisting of a circulator 74, a filter 73, a receiver mixer MRX1, a coupler 72, a microwave generator 69, a transmitter mixer MTX1, a receiver coupler 75 and a transmitter coupler 68.

The microwave generator supplies a signal at F=1846 MHz, which frequency is the same as that supplied by the microwave generator 19 of the ground station. The circulator 74 is connected to the transmitter mixer MTX1 on one hand and, via the filter 73, to the receiver mixer MRX1 on the other hand. The microwave generator 69 feeds the coupler 72, whose outputs are connected to the transmission mixer MTX1 and to the receiver mixer MRX1. The output of transmission coupler 68 is connected to the transmission mixer MTX1 and the input of the receiver coupler 75 is connected to the receiver mixer MRX1.

In reception, circulator 74 routes the received signals to the receiver mixer MRX1 which, by subtracting the frequency F, delivers to the receiver coupler 75 the subcarriers at 617.5 MHz, 624 MHz, 630.5 MHz, 637 MHz and 643.5 MHz, with their modulation, the 643.5 MHz check signal subcarrier alone being unmodulated, as indicated in the description of FIG. 1. Receiver coupler 75 is connected to a check receiver 76 which receives the 643.5 MHz subcarrier, as well as to a standard television receiver 77 that receives the 617.5 MHz and 624 MHz subcarrier corresponding to the video channel and its accompanying sound channel, to a multiplex sound receiver 78 that supplies s digital multiplex over a communications link 86 and to a digital receiver 79 that send the information in binary form over a link 87.

The check receiver 76 has outputs connected to a filter 81 and to an automatic gain control circuit 80, respectively, the latter AGC's output driving receivers 77, 78 and 79. Filter 81 is connected to a frequency divider 82, which divides by 92 and delivers a signal at 6.5 MHz to a phase comparator 83. A highly stable oscillator 85, of the voltage-controlled crystal type (VCXO), supplies a signal at 6.5 MHz, which is applied to the phase comparator 83 the output whereof is connected to a control input of the oscillator 85 via a filter 84. Oscillator 85 is thus locked in phase and frequency to the pilot frequency fp=6.5 MHz of the ground station.

The output of oscillator 85 is also connected to a coupler 52 feeding phase comparators 58, 59, 60, 61, 62 and 70 of the same type as those of the ground station. Phase comparators 58 to 62 have outputs connected to oscillator circuits 53, 54, 55, 56 and 57 respectively, of the same type as those of the ground station, each of said oscillator circuits having a modulation input and each corresponding to a transmission channel. The frequencies of oscillator circuits 53 through 57 may for example be 572 MHz, 578.5 MHz, 585 MHz, 591.5 MHz and 598 MHz; these frequencies are those of the subcarriers and attention is drawn to the fact that the 598 MHz subcarrier for the check signal is not modulated.

Oscillator circuit 53, for the 572 MHz subcarrier, corresponds to the video channel; as stated hereinbefore, the accompanying sound is transmitted along with other sounds by oscillator circuit 55, providing the 585 MHz subcarrier associated with the multiplex sound channel. Oscillator circuit 54, associated with the 578.5 MHz frequency subcarrier, is thus not used for the accompanying television sound. It is a spare oscillator and in fact can be absent entirely. Oscillator circuit 56 associated with the 591.5 MHz subcarrier corresponds to the digital channel and is modulated by a multiples of binary coded decimal data. Oscillator circuit 57 associated with the 598 MHz subcarrier corresponds to the check signal channel and is not modulated.

Each oscillator circuit 53 through 57 is output-connected to the transmission coupler 68 on the one hand and to the phase comparator associated therewith via a frequency divider 63 through 67, on the other hand. Frequency dividers 63 through 67 respectively divide by 88, by 89, by 90, by 91 and by 92. A 6.5 MHz signal effectively appears at the output of each divider.

The phase comparator 70 output is connected to the microwave generator 69, whose output is itself connected to the coupler 72 on the one hand and to the phase comparator 70, via a divide-by-284 frequency divider 71, on the other hand. This yields a 6.5 MHz signal as a result of dividing the F=1846 MHz frequency.

In the foregoing description of FIGS. 1 and 2, five oscillator circuits have been mentioned. However, it should be obvious that a different number of oscillators can be used within the scope of the invention, so suit the application or, otherwise stated, according to the type of mobile unit; for example, in the case of containment inspection, the truck may carry one or more television cameras, possibly a digital channel and one or more microphones, but never a television set; the check channel subcarrier always has the highest frequency of all the subcarriers. Obviously, the number of receivers will be increased accordingly. Likewise, the F frequency of the microwave carrier may be other than 1846 MHz, yet still be a multiple of the pilot frequency fp.

I claim:

1. A two-way information transmission system for communications between a ground control station connected to a waveguide and a vehicular mobile station connected to an antenna moving alongside the waveguide, each of said ground and mobile stations comprising a transmitter-receiver unit, the ground station transmitting in a higher frequency band than said vehicular station, wherein each transmitter-receiver unit comprises a pilot signal generator supplying a pilot frequency, a microwave generator supplying a carrier at a frequency that is a multiple of the pilot frequency, a coupler with input connected to the microwave generator, one output connected to a transmitter mixer and another output connected to a receiver mixer, transmitter circuits each connected to the pilot generator and each supplying a subcarrier at a frequency which is a multiple of the pilot frequency, the subcarriers having different, evenly spaced frequencies, the difference between successive subcarrier frequencies being equal to the pilot frequency and the frequencies of the subcarriers being less than the frequency of the carrier, a transmission coupler input-connected to the transmitter circuits and output-connected to the transmitter mixer, a circulator connected to the waveguide, to the transmitter mixer and, via a filter, to the receiver mixer, and a receiver coupler with an input connected to the receiver mixer and output connected to receivers to which it routes subcarriers that it receives from the waveguide via the receiver mixer.

2. A transmission system according to claim 1, further comprising means for modulating all the subcarriers except one, each by a different signal to be transnmitted, and wherein the unmodulated subcarrier constitutes a check signal.

3. A transmission system according to claim 1, wherein the pilot frequency is equal to the difference in television frequency between a video carrier and an accompanying sound carrier.

4. A transmission system according to claim 1, wherein each transmitter circuit has its input connected to a phase comparator having an input connected to the pilot generator and another input connected via a frequency divider to the output of the transmitter circuit.

5. A transmission system according to claim 1, wherein the microwave generator's input is connected to a phase comparator having one input connected to the pilot generator and another input connected via a frequency divider to the output of the microwave generator.

6. A transmission system according to claim 1, wherein the carriers of the microwave generators of the communicating stations have the same frequency.

7. A transmission system according to claim 1, wherein the frequencies of the subcarriers of the stations are located in the same frequency band, selected from among VHF band III, CATV, superband and UHF bands IV and V.

8. A transmission system according to claim 2, wherein a receiver in each station receives the unmodulated carrier and is connected to a frequency divider which delivers a signal at the same frequency as that supplied by the pilot generator, said frequency divider being connected, in the ground station, to a control circuit and, in the station aboard the vehicle, to an input of a phase comparator having another input connected to the output of the pilot generator and an output connected to a control input of the said pilot generator.

9. A transmission system according to claim 2, wherein a receiver in each station receives the unmodulated carrier and is output-connected to an automatic gain control circuit that is itself output-connected to a control input of the other receivers.

* * * * *